US008382601B2

(12) United States Patent
Gensert

(10) Patent No.: US 8,382,601 B2
(45) Date of Patent: Feb. 26, 2013

(54) METHOD AND DEVICE FOR MANUFACTURING FASTENINGS OR FASTENERS WITH RADIAL OUTER CONTOURS, ESPECIALLY SCREWS OR THREADED BOLTS

(75) Inventor: Hilmar Gensert, Bad Düben (DE)

(73) Assignee: Sieber Forming Solutions GmbH, Henstedt-Ulzburg (DE)

( * ) Notice: Subject to any disclaimer, the term of this patent is extended or adjusted under 35 U.S.C. 154(b) by 655 days.

(21) Appl. No.: 12/543,922

(22) Filed: Aug. 19, 2009

(65) Prior Publication Data

US 2010/0048309 A1 Feb. 25, 2010

Related U.S. Application Data

(60) Provisional application No. 61/101,376, filed on Sep. 30, 2008.

(30) Foreign Application Priority Data

Aug. 19, 2008 (DE) ..... 10 2008 038 185

(51) Int. Cl.
*B21H 3/00* (2006.01)
*B21D 22/00* (2006.01)

(52) U.S. Cl. ..... 470/8; 470/10; 470/58; 470/84; 72/356; 72/357

(58) Field of Classification Search ..... 72/352, 72/353.6, 354.2, 355.2, 356, 357, 360, 370.16; 470/8–11, 16, 58, 63, 84, 85
See application file for complete search history.

(56) References Cited

U.S. PATENT DOCUMENTS

| | | | | |
|---|---|---|---|---|
| 996,840 | A | 7/1911 | Deeds | |
| 2,020,660 | A | 11/1935 | Friedman | |
| 7,237,424 | B2 * | 7/2007 | Crutchley | 72/401 |
| 2008/0233779 | A1 | 9/2008 | Gibellini | |

FOREIGN PATENT DOCUMENTS

| | | | |
|---|---|---|---|
| DE | 83503 | C | 2/1895 |
| DE | 85 503 | | 3/1896 |
| DE | 691 145 | | 5/1940 |
| DE | 197 23 634 | A1 | 12/1997 |
| GB | 2420300 | A | 5/2006 |
| JP | 53108063 | A | 9/1978 |

* cited by examiner

*Primary Examiner* — Debra Sullivan
(74) *Attorney, Agent, or Firm* — Laurence A. Greenberg; Werner H. Stemer; Ralph E. Locher

(57) ABSTRACT

A method of manufacturing fastenings or fasteners with radial outer contours, especially screws or threaded bolts, made of solid metal is performed by a device. The method manufactures the fastenings or fasteners preferably on a multi-stage press. Several recesses running in an axial direction at a fixed radial distance are formed in the shank-shaped section of a blank. The prefabricated blank with the recesses is inserted into a multi-part split mold within a multi-stage press, whose die stocks have an inner profiling forming the outer contour, and are opened in the starting position, that at the places where the die stocks are opened, there are the recesses. During the closing movement of the die stocks, at least one radial outer contour is pressed on the shank-shaped section of the blank by radial action of forces, with the recesses preventing material from getting between the die stocks during the pressing process.

10 Claims, 2 Drawing Sheets

METHOD AND DEVICE FOR MANUFACTURING FASTENINGS OR FASTENERS WITH RADIAL OUTER CONTOURS, ESPECIALLY SCREWS OR THREADED BOLTS

CROSS-REFERENCE TO RELATED APPLICATION

This application claims the priority, under 35 U.S.C. §119 (e), of provisional application No. 61/101,376, filed Sep. 30, 2008; and also claims the priority, under 35 U.S.C. §119, of German patent application No. DE 10 2008 038 185.3, filed Aug. 19, 2008; the prior applications are herewith incorporated by reference in their entirety.

BACKGROUND OF THE INVENTION

Field of the Invention

The invention relates to a method of manufacturing fastenings or fasteners with radial outer contours, especially screws or threaded bolts, made of solid metal and a device intended for carrying out the method.

Screws or threaded bolts made of solid metal with diameters up to M36 are mass produced in a manner known per se using the cold extrusion process on multi-stage presses.

"Wire" wound on reels is used as the starting material and the screw blank is produced by forming processes (compressing, reducing, deburring) in multi-stage presses after appropriate pre-treatment (unwinding, smoothing). Several tool units, containing a punch and die and auxiliary tools in which the individual forming processes are carried out stage by stage in a defined sequence, are arranged in a so-called multi-stage press. Some processes require for example three press stages for manufacturing a screw blank from wire material: compressing, preforming the screw head, and final shaping of the screw head. The completed screw blank is produced on completion of the third stage. The outer thread is formed on the screw blank by thread rollers or rolling dies in a subsequent separate process in a non-cutting operation, with the surface of the threaded part being plastically deformed by the action of radial forces.

Cold extrusion presses with an integrated thread rolling machine are also known.

The manufacture of screws by hot pressing methods on forging presses is also known. After being cut to length, the round stock used in bar form is heated fully or partially (in gas, oil or induction furnaces) to the forging temperature (up to 1,250° C. dependent on material) and partially formed in presses. To complete such screws machining processes are then employed in most cases (CNC turning, thread cutting), with the threads manufactured on thread-rolling machines (2 or 3 roll machines) mainly without cutting.

The hot press method is however suitable only for small to medium quantities and diameters up to M200, and for materials that are difficult to form.

Two separate forming processes are necessary to manufacture screws using the cold extrusion method and subsequent rolling of the outer thread using thread-rolling machines. During the manufacture of the screw blank on the cold extrusion press, the screw blank is plastically deformed over its entire cross section. The material produced in the process flows mainly in an axial direction on the shank and in a radial direction at the head. During the rolling of the thread using a thread-rolling machine the required deformation is produced only on the surface by repeated rolling over with radial application of force.

A process is known from published, non-prosecuted German patent application No. DE 197 23 634 A1 for manufacturing connecting screws for the furniture industry. A rivet-shaped screw blank is manufactured from a wire blank by compression and extrusion in a multi-stage press with up to six stages. The process is carried out in compression and extrusion stages using suitable pressure rams which interact with associated dies. The completed screw blank is then fed to a thread-rolling machine on which the thread is rolled by flat dies.

In accordance with the known state of the art, the manufacture of threaded screws involves two different machine systems: a multi-stage press and a thread-rolling machine, with different tools being required. The multi-stage press and the thread-rolling machine require separate drive units because of the different force transmissions.

The machine systems required for manufacturing threaded screws are very expensive to procure and maintain.

SUMMARY OF THE INVENTION

It is accordingly an object of the invention to provide a method and a device for manufacturing fastenings or fasteners with radial outer contours, especially screws or threaded bolts that overcomes the above-mentioned disadvantages of the prior art methods and devices of this general type, which will result in a more economic production especially on a multi-stage press. In addition, a suitable device for carrying out the method is to be devised.

With the foregoing and other objects in view there is provided, in accordance with the invention, a method of manufacturing from a solid metal material fastenings or fasteners with radial outer contours, including screws and threaded bolts. The method includes forming, in a first pressing stage, several recesses running in an axial direction at a fixed radial distance in a shank-shaped section of a prefabricated blank with at least one of the shank-shaped sections for an intended radial outer contour. In a second pressing stage, the prefabricated blank with the recesses is inserted into a multi-part split mold having die stocks with an inner profiling forming the intended radial outer contour and which are opened in a starting position. The recesses are disposed at places where the die stocks are opened. The intended radial outer contour is pressed into the shank-shaped section of the prefabricated blank, resulting in a completed blank, by closing the die stocks by a radial action of forces, with the recesses running in the axial direction preventing material from getting between the die stocks of the multi-part split mold during a pressing process.

A prefabricated blank with a shank-shaped section on which a specific radial outer contour, preferably a thread, is to be formed is manufactured by one or more pressing processes from a blank of solid metal such as a wire section cut to length. The number of the extrusion press stages depends both on the blank and on the geometry of the finished product. In one of the upstream pressing stages (extrusion press processes) several recesses running in an axial direction at a fixed radial distance are formed in the shank-shaped section. In a further stage the completed blank is inserted into a multipart split mold with the die stocks open in the starting condition in such a way that there are recesses running in an axial direction at least at the points where the die stocks are opened. The individual die stocks of the pressing tool have a corresponding inner profiling on their inner side as a negative die for forming the radial outer contour.

By closing the die stocks, the desired radial outer contour is pressed on the shank-shaped section of the completed blank by the radial transmission of force. The recesses formed in the shank-shaped section of the blank prevent material getting between the die stocks of the split mold during the pressing process. No radial outer contour is produced during the pressing process in the area of the recesses extending in an axial direction.

The recesses formed can also be arch-shaped or semi-circular. Their size depends on the size of the outer contour to be formed, that is the thread.

The depth should be slightly greater than half the difference between the outer diameter and the minor thread diameter of the outer contour to be formed, that is the thread.

The width of the recesses should be at least as large as the opening gap between the die stocks when they come into contact with the blank. Suitably geometrically shaped bead-shaped sections are arranged on the inner side of the shank die to form the recesses. In addition, the pressing of the outer contours and the consequential material flow in a radial direction results in a hardening of the surface of the shank-shaped section. The profilings produced in this way have a higher mechanical loading capacity.

The process stages for manufacturing fastenings or fasteners with radial outer contours are carried out preferably within a multi-stage press.

The proposed method enables fastenings or fasteners with radial outer contours to be manufactured extremely economically. The preferred field of application is the manufacture of screws of all types as well as threaded bolts. The threads can have different geometries. Apart from threads, the term radial outer contours also covers other profilings such as individual grooves or undercuts which serve for example as a locking devices for the fastenings or fasteners. These can be arranged over the entire area of the shank-shaped section or even only at specified points. Fastenings or fasteners include devices that can be screwed or hammered in. This also includes for example screw nails, threaded nails, anchor nails or hooks.

In accordance with a further embodiment the number of the recesses running in an axial direction formed in the shank-shaped section is preferably based on the number of the die stocks in the split mold. In certain applications it may also be advisable to form more recesses than there are die stocks.

For example, six recesses running in an axial direction can be formed in the shank-shaped section, thereby subdividing the blank radially into six segments. A split mold with three die stocks is envisaged in this case for the subsequent pressing of the radial outer contours. The radial outer contours are then located on the individual segments.

The shank-shaped section can be cylindrical or cone shaped, depending on the shape of the fastenings or fasteners to be manufactured. The coned-shaped construction of the shank is carried out during one of the upstream pressing or compression stages within the multi-stage press.

During the pressing of the radial outer contour into the blank, the blank should be prevented from expanding in a longitudinal direction. Suitable stops have been provided in the split mold for this purpose.

The radial force component required to move the die stocks of the split mold can be produced via the pressing force bearing on the slide arranged in the multi-stage press. An additional advantage of this arrangement is that it dispenses with the need for a separate drive for the closing and opening movement of the split mold. The axial pressing force of the press slide can be changed into a radial force component by one or more wedge or cone-shaped elements which engage on the die stocks of the split mold. This is achieved either by moving the die stocks or the wedge or cone-shaped elements synchronously. The split mold is opened by carrying out the movement in the opposite direction.

In certain application cases it may be advisable to heat the blank before pressing the outer contour, either semi-hot to temperatures of up to approximately 700° C., or hot to temperatures of up to approximately 1,200° C. The heating can be provided directly by a heatable split mold or by a separate upstream heating device.

A device suitable for carrying out the method is constructed preferably as a multi-stage press which has a fixed tool carrier unit and a slide moveable in a direction towards the tool carrier unit, and at least one extrusion die and a downstream split mold with at least two radially movable die stocks which have on their inner side a radial profiling formed as a negative die. The extrusion die contains a head die and a shank die, with the shank die arranged on the slide and the head die arranged opposite on the tool carrier unit. On its inner side the shank die has at least two bead-shaped sections running in an axial direction which are arranged radially at the same distance as the opening gaps between the die stocks of the split mold. The device, especially the split mold, is fitted with locking elements which prevent a longitudinal expansion of the blank in the tool during the closing movement of the die stocks. The split mold is connected to a drive unit for the radial movement of the die stocks into the closing and opening position.

The split mold can also be fitted with its own drive unit.

Technically speaking, however, it is advantageous if the radial movement of the die stocks into the closing and opening position is activated by the movement of the slide. The split mold can be arranged either on the tool carrier unit or on the slide. The arrangement of the head die and shank die of the extrusion molding tool can also be altered in a similar manner.

An operating element by which the radial movement of the die stocks can be activated is arranged on the slide or on the tool carrier unit.

The split mold is formed preferably of an outer ring in which the die stocks are mounted so as to be radially movable, with the surface areas of the die stocks and the inner surface of the ring being of such a wedge or cone shape that the die stocks are movable into the closing and opening position on the axial movement of the ring or the die stocks. The ring is either fixed and the die stocks are still movable axially or the die stocks are only movable radially and the ring is movable axially. The ring can be of single or multi-part construction depending on the design of the split mould in question.

The axial movement of the ring or the die stocks is activated by an operating element constructed for example as a coiled bundle which engages on the front sides of the die stocks or on the outer ring. If the split mould is positioned on the tool carrier, the coiled bundle is arranged on the slide and vice versa.

Several bead-shaped sections can also be arranged on the inner side of the shank die in greater numbers than the number of the die stocks. The extrusion die can be fitted with ejectors, with at least one ejector constructed as a forming punch for forming an inner contour, e.g. as a hexagon socket of the screw head. The movement of the ejectors is controlled by a separate drive. The multi-stage press can also contain additional pressing or compressing tools, as well as a cutting device for cutting to length the wire fed in.

Other features which are considered as characteristic for the invention are set forth in the appended claims.

Although the invention is illustrated and described herein as embodied in a method and a device for manufacturing fastenings or fasteners with radial outer contours, especially screws or threaded bolts, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
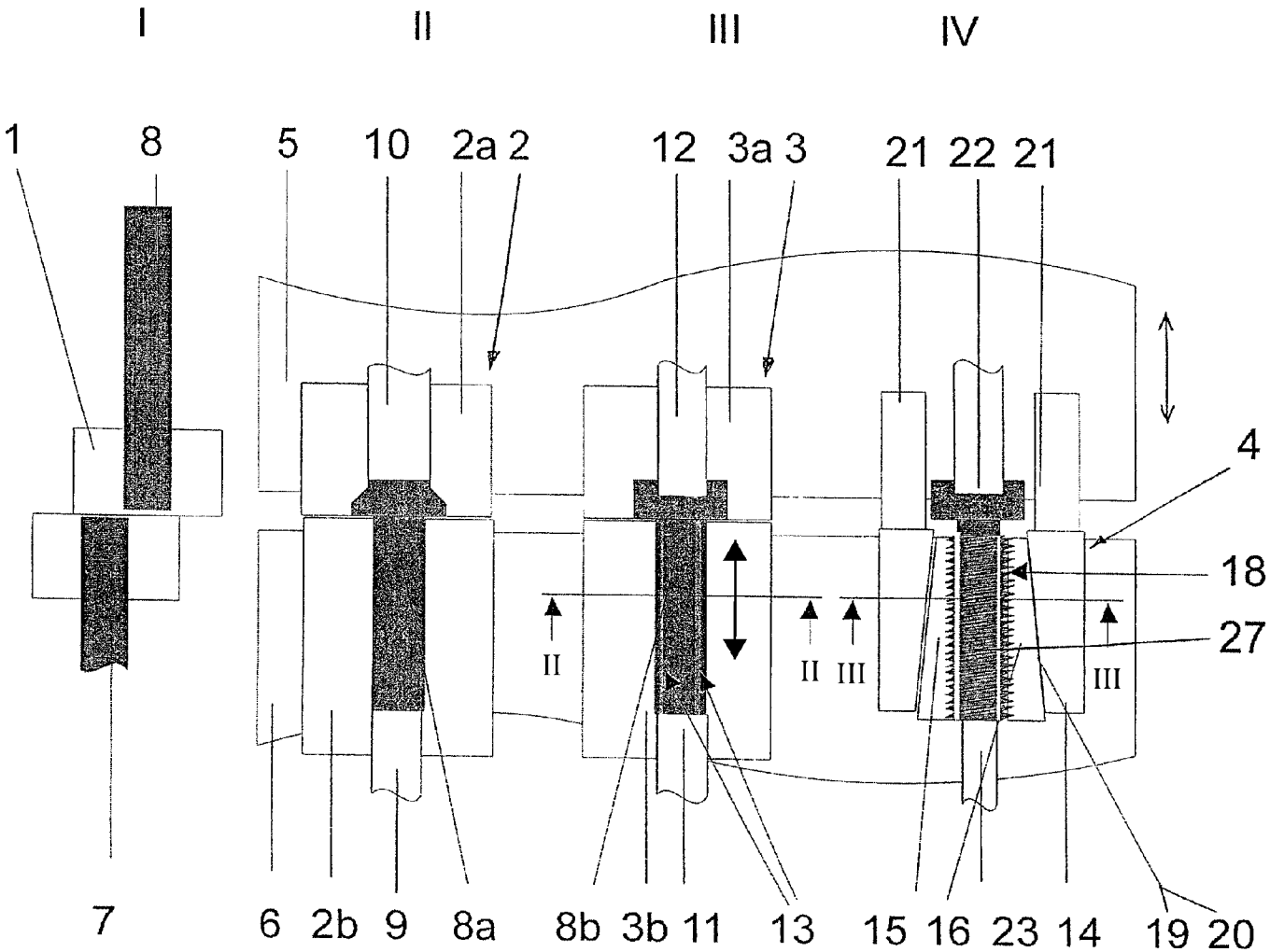
FIG. 1 is a diagrammatic illustration for showing individual process stages for manufacturing a hexagon socket screw in a chronological sequence according to the invention.

Referring now to the figures of the drawing in detail and first, particularly, to FIG. 1 thereof, there is shown process stages I to IV in a simplified representation for the manufacture of a hexagon socket screw in accordance with the invention and carried out within a multi-stage press constructed as a three-stage press. The multi-stage press, which is not shown in greater detail, is of a construction that is known per se, containing a frame with a movable slide 5 as well as a stationary tool carrier unit 6. In addition, a shearing tool 1 (process stage 1) as well as two extrusion molding tools 2, 3 (process stages II and III) and a thread pressing tool 4 (process stage IV) are arranged in the multi-stage press. The two extrusion molding tools 2 and 3 each consist of a head die 2*a*, 3*a* and a shank die 2*b*, 3*b*. The head dies 2*a* and 3*a* are arranged in the movable slide 5 and the opposite shank dies 2*b* and 3*b* are arranged in the stationary tool carrier unit 6, with a reversed arrangement also being possible.

Figure 2:
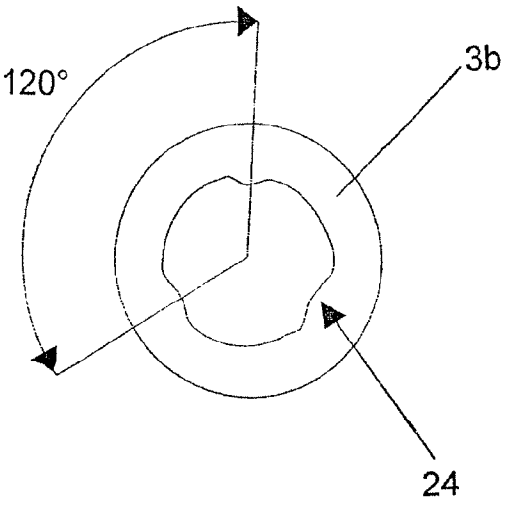
FIG. 2 is a diagrammatic, sectional view of the extrusion molding tool (without a blank) of process stage III taken along the line II-II shown in FIG. 1.

A wire 7 fed in as starting material is cut to a designated length in process stage I by the shearing blade 1 and a wire section 8 cut to length is inserted into the die cavity of the shank die 2*b* of the first extrusion molding tool 2 by a gripper or conveying device which is not shown in greater detail. A depth of a die cavity of the shank die 2*b* is limited by an initial ejector 9 fitted in the shank die 2*b*. A second ejector 10, which limits the die cavity of the head die 2*a* is also arranged opposite the first ejector 9 in the head die 2*a*. The wire section inserted is initially compressed by a cold extrusion process in process stage II by the movement of the slide 5 in the direction of the stationary tool carrier unit 6, with a shape similar to a screw head being formed on the upper part of a wire section 8*a*. On completion of process stage II and the movement of the slide 5 to its starting position, the preformed screw blank 8*a* is moved to a gripper or conveying device by the ejectors 9 and 10. The ejectors 9 and 10 are activated by a separate drive unit, independently of the movement of the slide 5. The screw blank 8a is then inserted into the die cavity of the shank die 3*b* of the second extrusion molding tool 3 by the gripper or conveying device. The die cavity of the shank die 3*b* and the head die 3*a* is limited by ejectors 11 and 12 in a similar way as with the first extrusion molding tool 2. On the inner side of the shank die 3*b* three bead-shaped sections 24 running in an axial direction (FIG. 2) are arranged which are intended to form recesses 13 running in an axial direction in the shank-shaped section of the screw blank 8*a*during the extrusion process in process stage III. The bead-shaped sections 24 are arranged at a defined radial distance from each other, since the recesses 13 must be located at least at the places where the die stocks of the downstream thread pressing tool 4 are opened or closed. The preformed screw blank 8*a* is shaped by a further cold extrusion process in the process stage III by the movement of the slide 5 towards the stationary tool carrier unit 6, with the screw head and the shank receiving their final shape in this process. The hexagon socket recess in the head of the screw blanks 8*a* is formed by the upper ejector 12, which serves at the same time as a pressure ram. The completed screw blank 8*b* produced after completion of process stage III has a shank with three identical recesses 13 running in an axial direction shown by the doubled headed arrow, which are arranged at an angle of 120° to each other. After completion of process stage III the slide 5 is returned to its starting position.

The thread pressing tool 4 is arranged downstream of the extrusion molding tool 3 in the tool carrier unit 6. In the example shown this consists of an outer ring 14 movable in an axial direction in which three die stocks 15, 16, 17 are mounted so as to be radially movable. The die stocks 15, 16, 17 have on their inner side a profiling formed as a thread 18 as a negative die. The outer ring 14 is guided on a cone-shaped outer surface 19 of the die stocks 15, 16, 17, tapering in the direction of the opening movement of the slide 5. The outer ring 14 has a cone-shaped inner surface 20 corresponding to the outer surface. When the split mold 4 is in the opened condition, the outer ring 14 projects above the front sides of the die stocks pointing in the direction of the slide 5. A projecting coiled bundle 21 which engages on the neighboring front surface of the ring 14 during the feed motion of the slide 5 is arranged in the slide 5 opposite the axially movable ring 14. During the feed motion of the slide 5, the outer ring 14 is moved in an axial direction, with the die stocks 15, 16, 17 being moved in a radial direction to press the thread.

Figure 3:
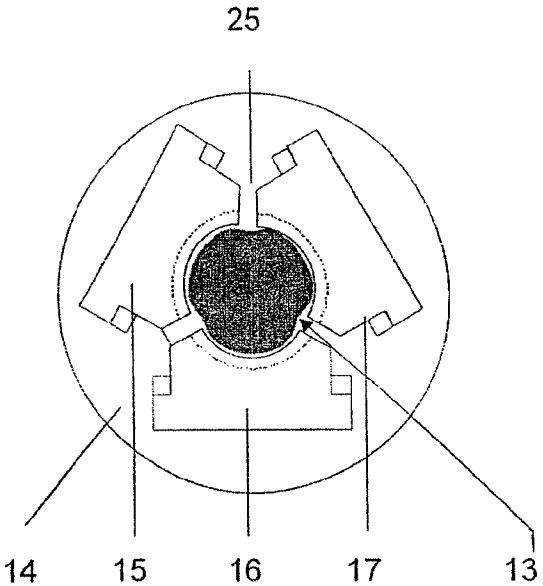
FIG. 3 is a diagrammatic, sectional view of a thread pressing tool of process stage IV in FIG. 1 with the split mold opened taken along the line III-III shown in FIG. 1.
Figure 4:
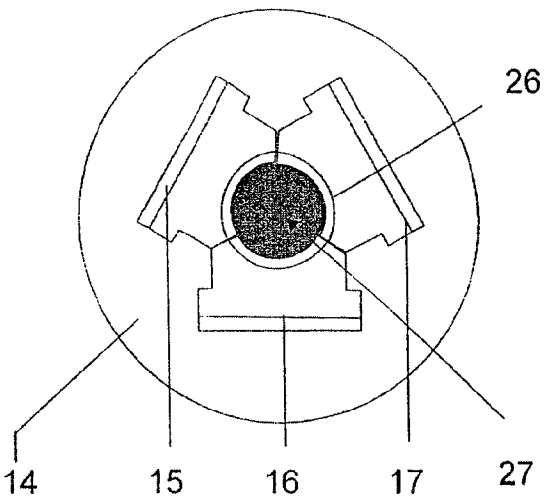
FIG. 4 is a diagrammatic, sectional view of the thread pressing tool of the process stage IV in FIG. 1 with the split mold closed taken along the line III-III shown in FIG. 1.

In process stage IV the completed screw blank 8*b* is removed from the extrusion molding tool 3 by the ejectors 10, 11 and inserted into the opened split mold 4 by a gripper or conveying device. The screw blank 8*b* is positioned in the process in such a manner that the three recesses 13 formed in the shank are in the exact position where the die stocks 15, 16, 17 are opened (opening gap 25), as shown in FIG. 3. In slide 5 an additional movable ejector is arranged, one end of which engages in the hexagon socket of the screw head. Opposite this an additional movable ejector 23 is also arranged in the tool carrier unit 6, which abuts on the front side of the shank of the screw blank 8*b*.

The slide 5 is advanced to press the thread into the shank of the screw blank 8*b*, with the outer ring 14 being moved and the thread 26 formed by the radial movement of the die stocks 15, 16, 17 that has been brought about. The two ejectors 22, 23 retain their starting position during the thread pressing process, thereby preventing an expansion of the screw blank 8*b* in a longitudinal direction during the pressing. The slide 5 is then returned to its starting position, the thread pressing tool 4 is opened and the completed screw 27 ejected.

The thread pressing tool can also be of a different design. However, it is advantageous if the opening and shutting movement of the die stocks is performed by the movement of the slide.

In practice the individual process stages I to IV are carried out synchronously. The individual pressing tools are for example arranged aligned in a line.

The number of the cold extrusion press stages upstream of the final thread pressing process depends on the shape and geometry of the particular fastenings or fasteners to be manufactured. Depending on the starting material used (metal wire) it may also be necessary to heat the screw blank before the thread pressing. The thread pressing tool can be fitted with an additional heating system.

The invention claimed is:

1. A method for producing fastenings or fasteners having radial outer contours from a solid metal, which comprises the steps of:

forming, in a first pressing stage, at least three recesses at a fixed radial distance in a prefabricated blank having at least one shank-shaped section;

performing a second pressing stage, by the steps of:

inserting the prefabricated blank with the recesses in a multi-part split mold with at least three die stocks in such a manner that the recesses are at places where the die stocks are open, in an open, starting position, the die stocks having an inner profile that forms an outer contour on the prefabricated blank; and performing a pressing process by closing the die stocks, by means of an application of a radial force, at least one radial outer contour is pressed into the shank-shaped section of the prefabricated blank resulting in a completed blank, and no radial outer contour is created during the pressing process in a region of the recesses extending in an axial direction, and that an entry of material between the die stocks of the multipart split mold is prevented during the pressing process by means of the recesses running in the axial direction.

2. The method according to claim 1, which further comprises governing a number of the recesses running in the axial direction by a number of the die stocks in the multipart split mold.

3. The method according to claim 1, which further comprises forming the recesses with arc shaped cross-sections.

4. The method according to claim 1, which further comprises setting a width of the recesses to be at least as large as an opening gap between the die stocks in a state when the die stocks come into contact with the prefabricated blank.

5. The method according to claim 1, which further comprises setting a depth of the recesses to be greater than one half of a difference between an outer diameter and an inner diameter of the outer contour to be formed, or a threading, respectively.

6. The method according to claim 1, which further comprises preventing the completed blank from expanding in a longitudinal direction during a pressing of the radial outer contours.

7. The method according to claim 1, which further comprises carrying out the first and second pressing stages inside a multi-stage press with a displaceable slide and a stationary tool carrier unit, whereby, for a prefabrication of the prefabricated blank, a metal wire cut to length is used as a starting material, and a cut wire section is formed as a blank in stages, in at least one extrusion or compression stage.

8. The method according to claim 7, which further comprises generating a radial force component necessary to move the die stocks of the multipart split mold by a displacement of the displaceable slide caused in the multi-stage press.

9. The method according to claim 7, wherein at least one axially displaceable wedge or cone shaped element engages in an outer surface of the die stocks of the multipart split mold, by means of which the displaceable slide of the multi-stage press causes a closing and opening of the multipart split mold.

10. The method according to claim 1, which further comprises forming the fastenings or fasteners as screws or threaded bolts.

* * * * *